United States Patent [19]

Hlavac

[11] 3,943,329

[45] Mar. 9, 1976

[54] HAIR DRYER WITH SAFETY GUARD AIR OUTLET NOZZLE

[75] Inventor: Andrew E. Hlavac, Long Valley, N.J.

[73] Assignee: Clairol Incorporated, New York, N.Y.

[22] Filed: May 17, 1974

[21] Appl. No.: 470,886

[52] U.S. Cl. ..... 219/367; 34/96; 219/368; 219/370; 219/373; 239/424; 417/89

[51] Int. Cl.[2].. H05B 1/00; F24H 3/04; F04B 23/14; A45D 20/12

[58] Field of Search ..... 219/359–376, 219/379–382; 417/84, 89, 76; 34/96–101, 243 R; 239/428.5, 424, 432

[56] References Cited

UNITED STATES PATENTS

| | | | |
|---|---|---|---|
| 1,594,906 | 8/1926 | Gross | 219/364 |
| 2,049,812 | 8/1936 | Loacker | 219/369 X |
| 2,275,295 | 3/1942 | Greenway | 165/123 X |
| 3,284,611 | 11/1966 | Laing | 219/370 |
| 3,612,824 | 10/1971 | Berryman | 219/370 |

*Primary Examiner*—A. Bartis
*Attorney, Agent, or Firm*—David J. Mugford; George A. Mentis; Samuel J. DuBoff

[57] ABSTRACT

A hair dryer includes a housing defining an air inlet and an air outlet and blower means within the housing for drawing a stream of air into the inlet, through the dryer housing and forcing the air out the air outlet. A thermostatically controlled electric heating element is disposed within the housing for heating the stream of air as it passes through the housing. A truncated safety guard member, which may be pyramidal or frustoconical in shape, is secured to the dryer housing over and in spaced relation to the air outlet and in communication therewith so that air from the outlet flows through the guard member to an air exit at the forward end thereof. The space between the dryer housing and guard member at the air outlet has a cross sectional area at least 50%, and preferably 90% to 100%, of the cross sectional area of the air outlet to allow sufficient air from the air outlet to exit between the guard member and dryer housing in the event the air exit of the guard member is completely blocked without overheating the dryer housing heating element or guard member. A protective grill having air outlet openings with a total area greater than the cross sectional area of the air outlet is provided over the air exit of the guard member. The protective grill is spaced from the air outlet a distance greater than one-half the inside width of the air outlet. Preferably the distance is equal to such width. In normal operation ambient air enters the guard through the space between the guard and dryer housing and mixes with the heated air from the air outlet thereby lowering the temperature of the heated air from the air outlet and increasing the volume of air.

8 Claims, 5 Drawing Figures

THERMAL SWITCH

HAIR DRYER WITH SAFETY GUARD AIR OUTLET NOZZLE

BACKGROUND OF THE INVENTION

1. Field of the Invention

The present invention is directed to a novel hand held hair dryer. More particularly, the present invention is directed to a hand held hair dryer having a safety device attached to its exit nozzle.

2. Discussion of the Prior Art

Hand held hair dryers and heat guns produce a heated air stream by passing the air generated from an electric blower over a heating means such as resistance wire. With the tendency to increase wattage in hair dryers the exit temperatures especially close to the air exit, reach temperatures that will singe or otherwise damage the user's hair and can also cause injury to the user's scalp. To prevent injury to the hair or scalp the user must keep the exit portion of the hair dryer a distance away from the hair. This is difficult as hair is a good insulator and may become singed before the user feels excess heat on the scalp. Judgment of the proper distance to maintain between the air exit and the hair is difficult as the heat increases by the square of the distance between the air exit and the hair.

Another problem which exists in commercial hand held hair dryers is that if in use the exit is partially or fully blocked off, the air flow over the heating element is greatly reduced or completely cut off, causing the heating element to overheat resulting in damage to the heating element. Most heat guns and hair dryers have bimetallic thermal protectors, however, due to the thermal delay in their action, the heating element as well as the housing and other parts within the housing are thermally overstressed before the contacts open to stop the current flow to the heating element, reducing their integrity and life. After opening of the contacts and removal of the blockage of the exit causing the overloading of the heating element, a substantial time must pass until the entire system cools down sufficiently and the thermal protector resets. During this period the hair dryer cannot be operated. Additionally, in the event the thermal protector fails or the hair dryer does not contain such a safety device the unit will be permanently damaged and can cause injury to person and property. Thus, the hair dryers existing in the art have not proven to be entirely satisfactory.

Numerous existing patents disclose hand held hair dryers or portable heat guns. Examples of such patents are U.S. Pat. Nos. 3,284,611 and 3,612,824. Neither of these patents recognizes the problems described above and accordingly do not disclose a hair dryer having a guard member with the optimal configuration for the purposes to which this inventor has directed his efforts.

SUMMARY OF THE INVENTION

Accordingly, it is an object of the present invention to provide a new and improved hair dryer.

Another object of the present invention is to provide a new and improved hair dryer having means to prevent injury to hair or scalp due to excessive air temperature.

A further object of the present invention is to provide a new and improved hair dryer having means to prevent damage to the hair dryer from overheating in the event of blockage of the air exit of the hair dryer.

The above and other objects which will appear as this specification proceeds have been attained by the hand held hair dryer of this invention.

The hair dryer of this invention comprises a housing, the housing defining an air inlet and an air outlet, blower means disposed within the housing for drawing a stream of air into the air inlet, through the dryer housing and forcing it out the air outlet, heating means disposed within the housing for heating the stream of air as it passes through the dryer housing and a guard member secured to the dryer housing over the air outlet and in communication therewith so that air flowing from the outlet flows through the guard member, the guard member having an air exit, a casing in spaced relationship to the dryer housing the space between the casing and the dryer housing being of adequate cross sectional area to allow sufficient air from the air outlet to exit between the casing and the dryer housing in the event of complete blockage of the air exit of the guard member without causing overheating of the heating means, dryer housing or guard member, a protective grill over the air exit and means for maintaining the casing in spaced relationship with respect to the dryer housing.

Partial or total blockage of the air exit of the hair dryer of this invention does not result in damage through excessive temperature to the dryer housing, or heating means or produce overheating of the grill guard at the air exit. In the event of blockage, the air continues to flow through the dryer housing but all or a portion of the air depending upon the extent of blockage exits through the space between the guard member and the dryer housing. Additionally, in normal operation ambient air enters the guard member through the space between the guard member and the dryer housing and mixes with air from the air outlet, thereby lowering the temperature of the air from the air outlet and increasing the volume of air. The lower air temperature results in a lower grill temperature which is safe in the event the hair of the user comes in contact with the grill.

DESCRIPTION OF THE PREFERRED EMBODIMENT

Figures 1, 2, 3, 4, 5:
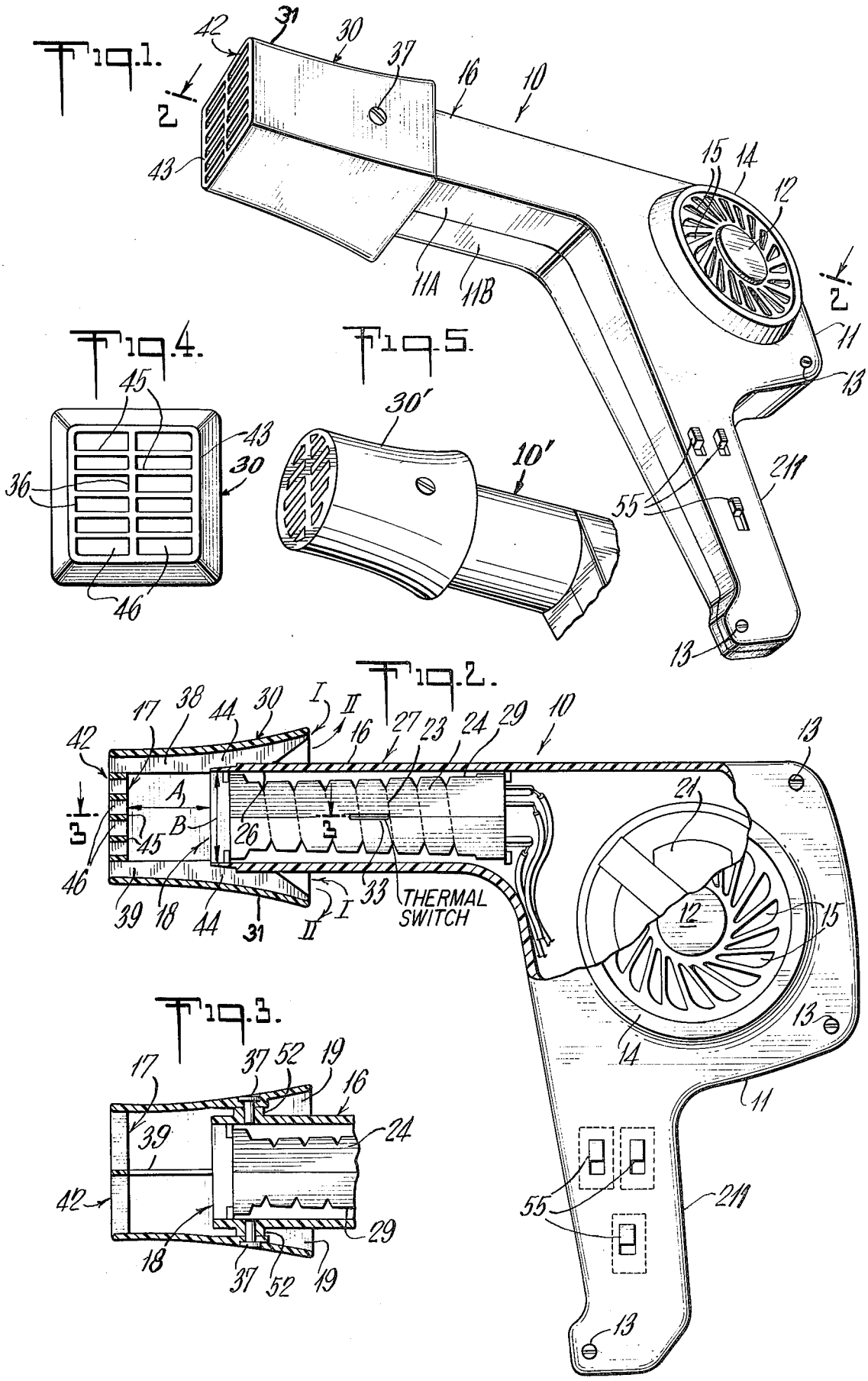
FIG. 1 is a view in perspective of a hair dryer assembly in accordance with the invention.
FIG. 2 is a side view partially in cross section taken along the line 2—2 of FIG. 1.
FIG. 3 is a view in cross section taken along the line 3—3 of FIG. 2.
FIG. 4 is an end view of the hair dryer showing the air exit.
FIG. 5 is a cutoff view in perspective showing another embodiment of a hair dryer assembly depicted in FIG. 1.

Referring now to the drawings, the hair dryer of this invention is generally referred to by the reference numeral 10. The hair dryer 10 comprises a housing 11 which consists of two portions 11A and 11B which are held together by means of screws 13, as illustrated in FIG. 1. The housing is preferably made from a plastic material.

The housing contains an air inlet 14 having a series of elongated slots 15 extending radially from center portion 12 of the housing and a nozzle portion 16. The nozzle portion 16 is generally tubular and comprises an inner wall 26 and an outer wall 27. An air outlet 18 is provided at the distal end of the nozzle. The housing further comprises a handle portion 211 containing switches 55.

Suitably positioned within the housing 11 as illustrated in FIG. 2 is a blower 21 comprising a fan (not shown) suitably connected to and driven by an electric motor (not shown). The blower is mounted adjacent the air inlet 14 and in operation draws a stream of air into the air inlet 14, forces the air through the dryer housing 11 and out the air outlet 18 of nozzle 16.

The hair dryer 10 further comprises an electrical heating means 24 suitably mounted on the inner wall 26 of nozzle 16 and extending along the nozzle length for heating air passing through nozzle 16. The electrical heating means 24 comprises resistance wire 23 wound about a plate-like insulating support 29 mounted within nozzle 16. An overload cutout or thermal switch 33 is provided to open the circuit to heating means 24 in the event of overheating. An electrical power cord (not shown) extends through handle portion 211 of the housing 11 and supplies power to the blower 21 and heating means 24.

The hair dryer further comprises a guard member 30 mounted on the outer wall 27 of the nozzle 16 and over the outlet 18 so as to have its longitudinal axis aligned with the longitudinal axis of nozzle 16. The nozzle 16 contains nipples 52 extending from the outer wall 27 arranged for mounting guard member 30 into the nozzle 16. The guard member 30 is secured to the nozzle 16 as shown in FIG. 3 by two screws 37 extending through the guard member 30 into nipples 52. The screws 37 also aid in holding the portions 11A and 11B of housing 11 together.

The guard member 30 includes a casing 31 and an upper fan rib 38 and a lower fan rib 39 mounted on the inside of the casing 31 which preferably taper in the direction toward the air outlet 18. The fan ribs 38 and 39 engage the outer wall 27 of the nozzle 16 to maintain the casing in spaced relationship to the outer wall 27 of the nozzle 16 and stabilize the guard member 30. The ribs 38 and 39 have notched recesses 44 which locate the guard member longitudinally.

Guard member 30 has an exit 42 and an open end 19. A protective grill 43 as best seen in FIG. 4 is mounted over the exit 42. The grill 43 has a plurality of horizontal bars 45 and vertical bars 36 defining a plurality of air outlet slots 46. In normal operation of the hair dryer, air flows from air outlet 18 through the guard member 30 and out through the air outlet slots 46.

The guard member 30 is preferably made of a plastic material and the casing 31 is in the general shape of a truncated pyramid or may be generally frusto-conical in shape as depicted by guard member 30' attached to the housing of hair dryer 10' in FIG. 5. The casing 31 has a concave profile having a greater diameter at open end 19 than at air exit 42.

It has been found that distance A between air outlet 18 and the inside surface 17 of bars 36 and 45 should be greater than one-half the inside diameter or width B of nozzle 16 at the air outlet 18 and preferably distance A should be about equal to inside diameter B. The cross sectional area or raadial clearance between nozzle 16 and guard member 30 at the air outlet 18 must be at least 50% of the cross sectional area of nozzle 16 at the air outlet 18 to permit sufficient reverse flow of air from the blower when the exit 42 of guard member 30 is completely blocked to prevent the temperature of the outside surface of grill 43 from increasing to a temperature sufficient to damage hair or cause overheating of the dryer to damage the dryer or cause the safety thermostat to trip. Preferably, the cross sectional area should be 90% to 100% of the cross sectional area of nozzle 16 to obtain excellent reverse flow of air and prevent overheating.

To prevent impeding air flow, it was found that the area of air outlets slots 46 is required to be greater than the cross sectional area of the nozzle 16 at the air outlet 18. When the area of air outlet slots 46 is equal to at least 115% of the cross sectional area of the nozzle 16 excellent dryer operation is obtained.

In operation of the hair dryer, the blower 21 induces a flow of air through the air inlet 14 through nozzle portion 16 and out the air outlet 18, through guard member 30 and out of the exit 42. In passing through the nozzle 16, the air is heated by the heating means 24. During the normal operation, air flows in direction I between the guard member 30 and the nozzle 16 which mixes with heated air leaving the air outlet 18. When the preferred dimensions are utilized for guard member 30, the air volume from air outlet 18 is increased about 8%. In the event exit 42 becomes partially or completely blocked, all or a portion of the air flow depending upon the amount of blockage will exit through the annular space between the guard member 30 and nozzle 16 in the direction II. Thus, in the event of complete blockage of the exit 42 heated air will flow through the hair dryer without causing grill 43 or the heating element to become overheated and thereby preventing damage to the hair of the user and to the heating element.

Thus, it is apparent from the foregoing description that the objects of this invention have been attained. A novel hair dryer has been invented which overcomes problems associated with hair dryers known in the art.

While this invention has been described and exemplified in terms of its preferred embodiment, those skilled in the art will appreciate that modifications can be made without departing from the spirit and scope of this invention.

I claim:

1. A hair dryer comprising a housing, said housing defining an air inlet and an air outlet, blower means disposed within the housing for drawing a stream of air into the air inlet, through the dryer housing and forcing it out the air outlet, said air outlet being generally in the shape of a square, heating means disposed within the housing for heating the stream of air as it passes through the dryer housing and a guard member secured to the dryer housing over the air outlet and in communication therewith so that air flowing from said outlet flows through said guard member, said guard member having an open end, an air exit, and a casing generally in the shape of a truncated pyramid in spaced relationship to the dryer housing providing flow communication between the open end and air exit, the space between the casing and the dryer housing having a cross sectional area at the air outlet of at least about 50% of the cross-sectional area of the air outlet, to allow sufficient heated air from the air outlet to exit between the casing and the dryer housing out the open end in the event of complete blockage of the air exit of said guard member without causing overheating of the heating means, dryer housing or guard member, or alternatively under normal operation with no blockage present, to allow a sufficient flow of ambient air to be induced to flow into the open end and through the space as a result of the flow of heated air from the air outlet through the air exit, the ambient air mixing with the heated air passing through said air exit, a protective grill over the air exit and means for maintaining the casing in spaced relationship with respect to the dryer housing, wherein the distance between the protective grill and the air outlet is greater than about one-half the inside width of the air outlet and wherein the protective grill contains air outlet openings having a total area greater than the cross-sectional area of the air outlet.

2. A hair dryer in accordance with claim 1, in which said cross sectional area of the space is from about 90% to about 100% of the cross sectional area of the air outlet.

3. A hair dryer in accordance with claim 1, in which the distance is about equal to the inside width of the air outlet.

4. A hair dryer in accordance with claim 1, in which the total area of the grill openings is about 115% of the cross sectional area of the air outlet.

5. A hair dryer in accordance with claim 1, in which the guard member contains at least two fan ribs spaced to maintain the casing in spaced relationship with respect to the dryer housing.

6. A hair dryer comprising a housing, said housing defining an air inlet and an air outlet, blower means disposed within the housing for drawing a stream of air into the air inlet, through the dryer housing and forcing it out the air outlet, said air outlet being generally in the shape of a circle, heating means disposed within the housing for heating the stream of air as it passes through the dryer housing and a guard member secured to the dryer housing over the air outlet and in communication therewith so that air flowing from said outlet flows through said guard member, said guard member having an open end, an air exit, and a casing generally of frusto-conical shape in spaced relationship to the dryer housing providing flow communication between the open end and air exit, the space between the casing and the dryer housing having a cross sectional area at the air outlet of at least about 50% of the cross sectional area of the air outlet to allow sufficient heated air from the air outlet to exit between the casing and the dryer housing out the open end in the event of complete blockage of the air exit of said guard member without causing overheating of the heating means, dryer housing or guard member, or alternatively under normal operation with no blockage present, to allow a sufficient flow of ambient air to be induced to flow into the open end and through the space as a result of the flow of heated air from the air outlet through the air exit, the ambient air mixing with the heated air passing through said air exit, a protective grill over the air exit and means for maintaining the casing in spaced relationship with respect to the dryer housing, wherein the distance between the protective grill and the air outlet is greater than about one-half the inside diameter of the air outlet and wherein the protective grill contains air outlet openings having a total area greater than about the cross sectional area of the air outlet.

7. A hair dryer comprising a housing, said housing defining an air inlet and an air outlet, blower means disposed within the housing for drawing a stream of air into the air inlet, through the dryer housing and forcing it out the air outlet, said air outlet being generally in the shape of a square, heating means disposed within the housing for heating the stream of air as it passes through the dryer housing over the air outlet and in communication therewith so that air flowing from said outlet flows through said guard member, said guard member having an open end, an air exit, and a casing generally in the shape of a truncated pyramid in spaced relationship to the dryer housing providing flow communication between the open end and air exit, the space between the casing and the dryer housing having a cross sectional area at the air outlet of from about 90% to about 100% of the cross sectional area of the air outlet to allow sufficient heated air from the air outlet to exit between the casing and the dryer housing out the open end in the event of complete blockage of the air exit of said guard member without causing overheating of the heating means, dryer housing or guard member, or alternatively under normal operation with no blockage present, to allow a sufficient flow of ambient air to be induced to flow into the open end and through the space as a result of the flow of heated air from the air outlet through the air exit, the ambient air mixing with the heated air passing through said air exit, a protective grill over the air exit and means for maintaining the casing in spaced relationship with respect to the dryer housing, wherein the distance between the protective grill and the air outlet is about equal to the inside width of the air outlet and wherein the protective grill contains openings having a total area equal to about 115% of the cross sectional area of the air outlet.

8. A hair dryer in accordance with claim 7 in which the guard member contains at least two spaced fan ribs to maintain the casing in spaced relationship with respect to the dryer housing.

* * * * *